US008353509B2

(12) United States Patent
Oota et al.

(10) Patent No.: US 8,353,509 B2
(45) Date of Patent: Jan. 15, 2013

(54) STACKER DEVICE

(75) Inventors: Ryuichi Oota, Kinokawa (JP); Hideki Oiwa, Kinokawa (JP); Masasuke Funase, Kinokawa (JP); Takaaki Maeda, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 0 days.

(21) Appl. No.: 13/257,632

(22) PCT Filed: Feb. 15, 2010

(86) PCT No.: PCT/JP2010/052156
§ 371 (c)(1),
(2), (4) Date: Sep. 20, 2011

(87) PCT Pub. No.: WO2010/109974
PCT Pub. Date: Sep. 30, 2010

(65) Prior Publication Data

US 2012/0007306 A1 Jan. 12, 2012

(30) Foreign Application Priority Data

Mar. 27, 2009 (JP) ..... 2009-079499

(51) Int. Cl.
*B65H 29/46* (2006.01)
*B65H 31/06* (2006.01)

(52) U.S. Cl. ..... 271/181; 271/180; 271/213; 271/214; 271/216

(58) Field of Classification Search ..... 271/181, 271/180, 213, 214, 216
See application file for complete search history.

(56) References Cited

U.S. PATENT DOCUMENTS 4,867,435 A * 9/1989 Cogswell et al. ..... 271/182
(Continued)

FOREIGN PATENT DOCUMENTS

JP 59-173654 U 11/1984
(Continued)

OTHER PUBLICATIONS

International Search Report (PCT/ISA/210) issued on Mar. 30, 2010, by Japanese Patent Office as the International Searching Authority for International Application No. PCT/JP2010/052156.

(Continued)

*Primary Examiner* — Luis A Gonzalez
(74) *Attorney, Agent, or Firm* — Buchanan Ingersoll & Rooney PC

(57) ABSTRACT

A stacker device includes a conveying belt, a longitudinal receiving guide, a paper sheet discharge detecting part, a first detecting part having a rod body, a second detecting part, and a control part for controlling the guide drive mechanism and the belt drive mechanism. The control part is formed so as to control both the mechanisms so that after the predetermined time T, which is required for the paper sheet to be stacked on the stacking surface after the paper sheet discharge detecting part detects the rear edge of the paper sheet having been conveyed to the discharging roller, passes and until the first detecting part detects the paper sheet, the longitudinal receiving guide and the conveying belt move to the upstream side of the conveyance direction at the same time, and after that, until the first detecting part does not detect the paper sheet, the longitudinal receiving guide and the conveying belt move to the downstream side of the conveyance direction at the same time. Additionally, the control part is formed so as to control the belt drive mechanism so that, when the second detecting part detects the non-standing position of the paper sheet, only the conveying belt moves to the downstream side of the conveyance direction by the predetermined distance.

2 Claims, 8 Drawing Sheets

U.S. PATENT DOCUMENTS

| | | | | |
|---|---|---|---|---|
| 4,940,219 | A * | 7/1990 | Volat | 271/2 |
| 7,828,277 | B2 * | 11/2010 | Kayahara et al. | 270/58.12 |

FOREIGN PATENT DOCUMENTS

| | | | |
|---|---|---|---|
| JP | 61-55061 | A | 3/1986 |
| JP | 10-194553 | A | 7/1998 |
| JP | 2007-119088 | A | 5/2007 |
| JP | 2007-230659 | A | 9/2007 |

OTHER PUBLICATIONS

Written Opinion (PCT/ISA/237) issued on Mar. 30, 2010, by Japanese Patent Office as the International Searching Authority for International Application No. PCT/JP2010/052156.

* cited by examiner

STACKER DEVICE

TECHNICAL FIELD

The present invention relates to a stacker device for stacking paper sheets, which have been discharged from a discharging roller in a folded form, sequentially in a standing position from a downstream side of a conveyance direction to an upstream side of the conveyance direction.

BACKGROUND OF THE INVENTION

The above-mentioned stacker device has been disclosed in Patent Documents 1 and 2, for example. These devices are formed so as to convey paper sheets to a longitudinal receiving guide by a conveying belt and receive paper sheets in a standing position by the longitudinal receiving guide.

Patent Document 1: Japanese Unexamined Patent Application Publication No. 10-194553

Patent Document 2: Japanese Unexamined Patent Application Publication No. 2007-119088

DISCLOSURE OF THE INVENTION

Problems to be Solved by the Invention

In the above-mentioned device, since the conveying belt always moves at a constant speed, a lower edge of the paper sheet received by the longitudinal receiving guide always slidingly makes contact with the conveying belt. That results a problem such that the lower edge of the paper sheet is damaged or a stacked state of the paper sheets are collapsed by an oscillation of the stacked paper sheets.

An object of the present invention is to provide a stacker device which can overcome the above-mentioned problem.

Solution to the Problems

The present invention is a stacker device for stacking paper sheets, which have been discharged from a discharging roller in a folded form, sequentially in a standing position from a downstream side of a conveyance direction to an upstream side of the conveyance direction. The stacker device comprises: a conveying belt which constructs a stacking surface of the paper sheet and which is provided movable in the conveyance direction by a belt drive mechanism; a longitudinal receiving guide which is provided movable on the stacking surface in the conveyance direction by a guide drive mechanism and which receives the paper sheets having been discharged, in the standing position in the upstream side of the conveyance direction; a paper sheet discharge detecting part for detecting a rear edge of the paper sheet having been conveyed to the discharging roller; a first detecting part for detecting that the paper sheet which is stacked on the stacking surface and which is in the most upstream side of the conveyance direction makes contact with a horizontal rod body which is orthogonal to the conveyance direction and which is located above the stacking surface, from the downstream side of the conveyance direction; and a control part for controlling the guide drive mechanism and the belt drive mechanism. In the stacker device, the control part is formed so as to control both of the guide drive mechanism and the belt drive mechanism so that after the predetermined time, which is required for the paper sheet to be stacked on the stacking surface after the paper sheet discharge detecting part detects the rear edge of the paper sheet having been conveyed to the discharging roller, passes and until the first detecting part detects the paper sheet, the longitudinal receiving guide and the conveying belt move to the upstream side of the conveyance direction at the same time, and after that, until the first detecting part does not detect the paper sheet, the longitudinal receiving guide and the conveying belt move to the downstream side of the conveyance direction at the same time.

Also, the present invention preferably employs the following structure (a).

(a) The stacker device further comprises a second detecting part for detecting a non-standing position of the paper sheet in the upstream side of the conveyance direction on the stacking surface, wherein the control part is formed so as to control the belt drive mechanism so that, when the second detecting part detects the non-standing position of the paper sheet, only the conveying belt moves to the downstream side of the conveyance direction by the predetermined distance.

Effects of the Invention

In the present invention, each time one of the paper sheets is stacked on the stacking surface, the conveying belt moves to the upstream side of the conveyance direction and then moves to the downstream side of the conveyance direction, together with the longitudinal receiving guide, i.e., together with the stacked paper sheets. Therefore, according to the present invention, the following effects can be exerted.

(1) The conveying belt hardly slidingly makes contact with the lower edges of the stacked paper sheets. Therefore, the lower edges of the paper sheets can be prevented from being damaged.

(2) Each time one of the paper sheets is stacked on the stacking surface, all the stacked paper sheets are swung between the longitudinal receiving guide and the rod body. Therefore, each time the paper sheet is stacked, a stacked state of the paper sheets is fixed. Accordingly, the stacked state of the paper sheets can be stabilized and the stacked paper sheets can be controlled from being collapsed.

According to the above-mentioned structure (a), the paper sheets can stand. Therefore, it is possible to eliminate the need for manual works to rebuild the collapsed paper sheets. Accordingly, the work efficiency of the device can be improved.

DESCRIPTION OF REFERENCE NUMERALS

1: discharging roller, 10: stacker device, 100: paper sheet, 102: lower edge, 103: rear edge, 21: conveying belt, 22: belt drive mechanism, 200: stacking surface, 31: longitudinal receiving guide, 32: guide drive mechanism, 5: paper sheet discharge detecting part, 6: first detecting part, 7: second detecting part

BEST MODE FOR CARRYING OUT THE INVENTION

Figure 1:
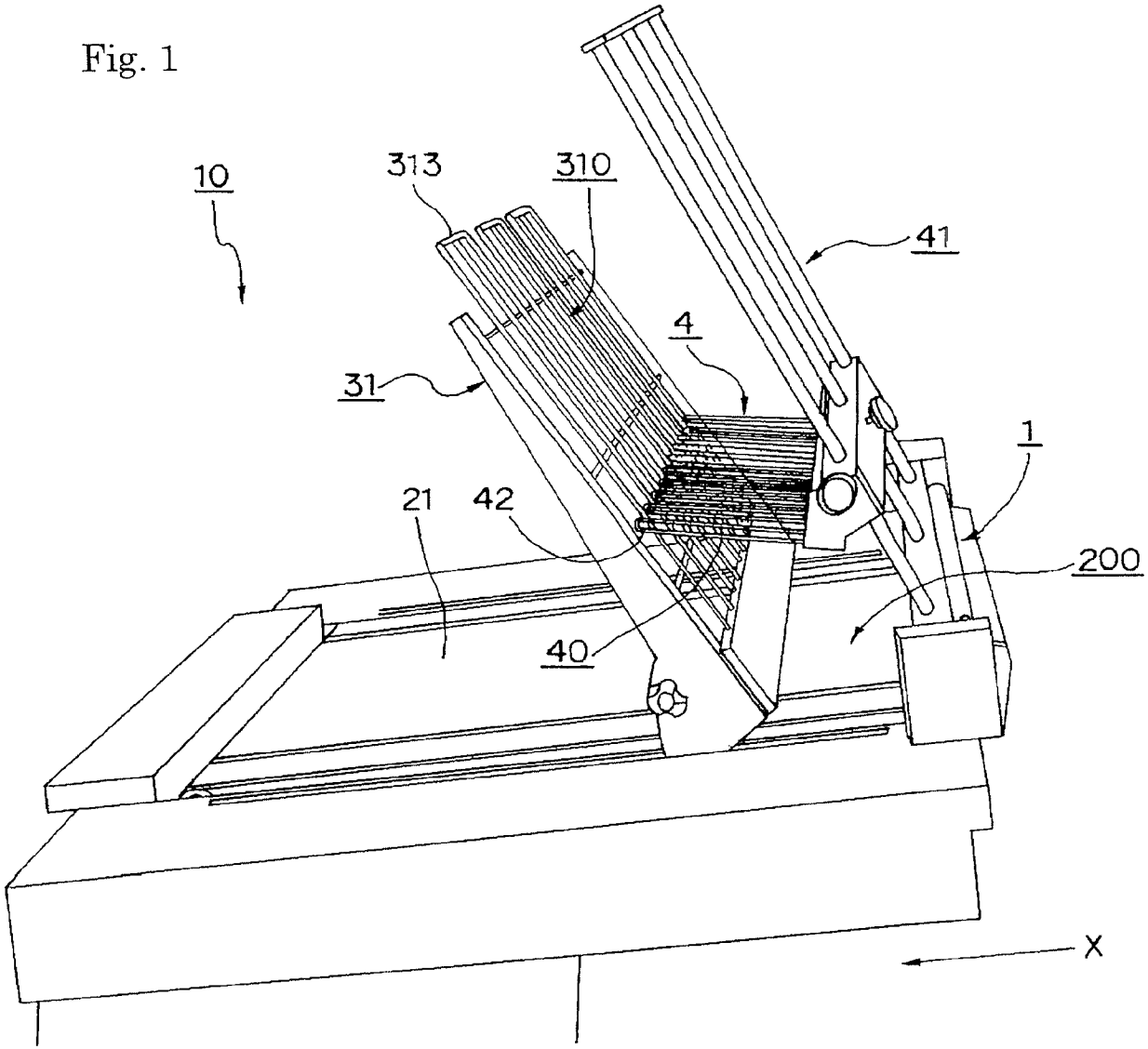
FIG. 1 is a perspective view of an embodiment of a stacker device of the present invention.
Figure 2:
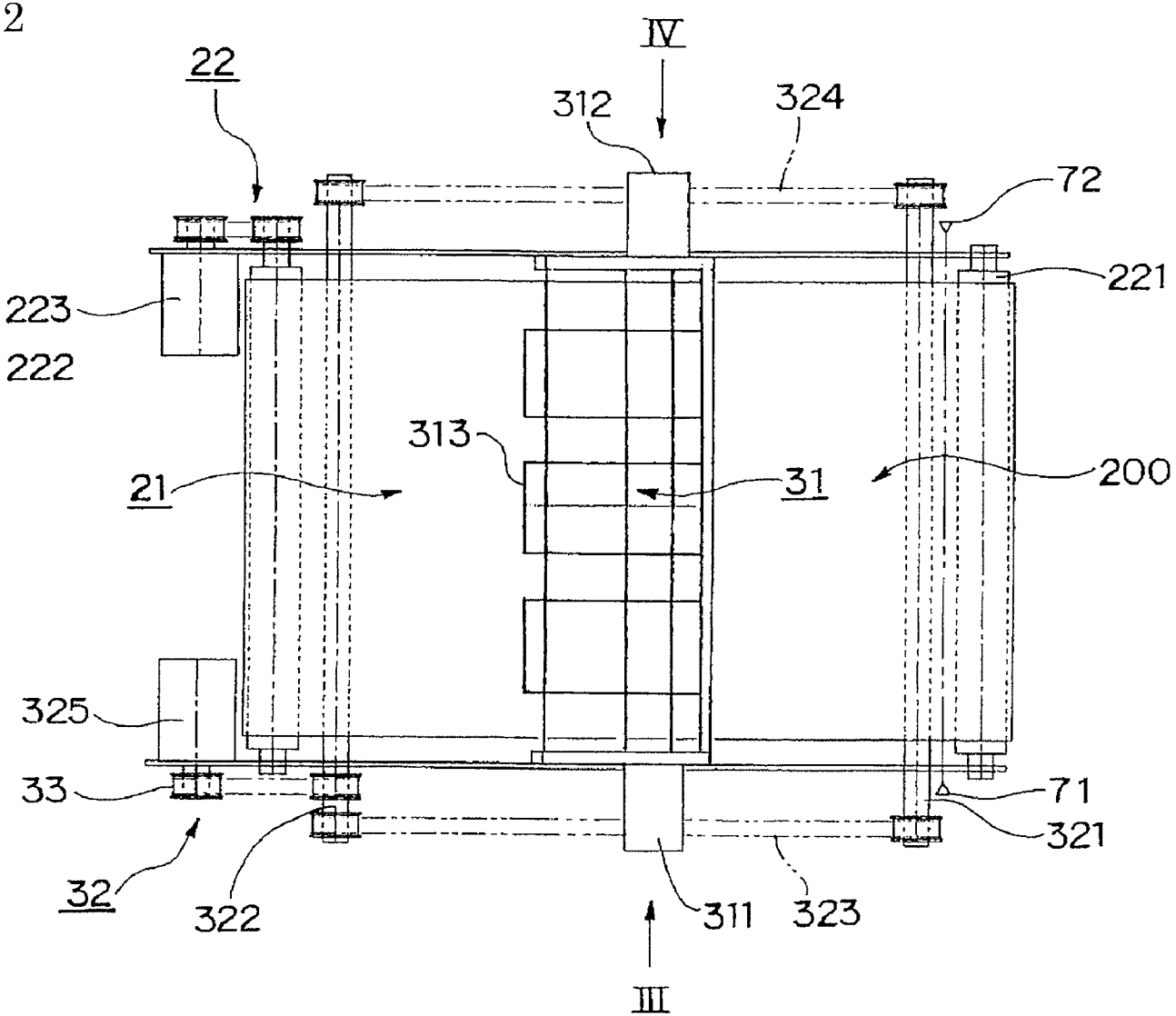
FIG. 2 is a partially abbreviated plan view of the stacker device.
Figure 3:
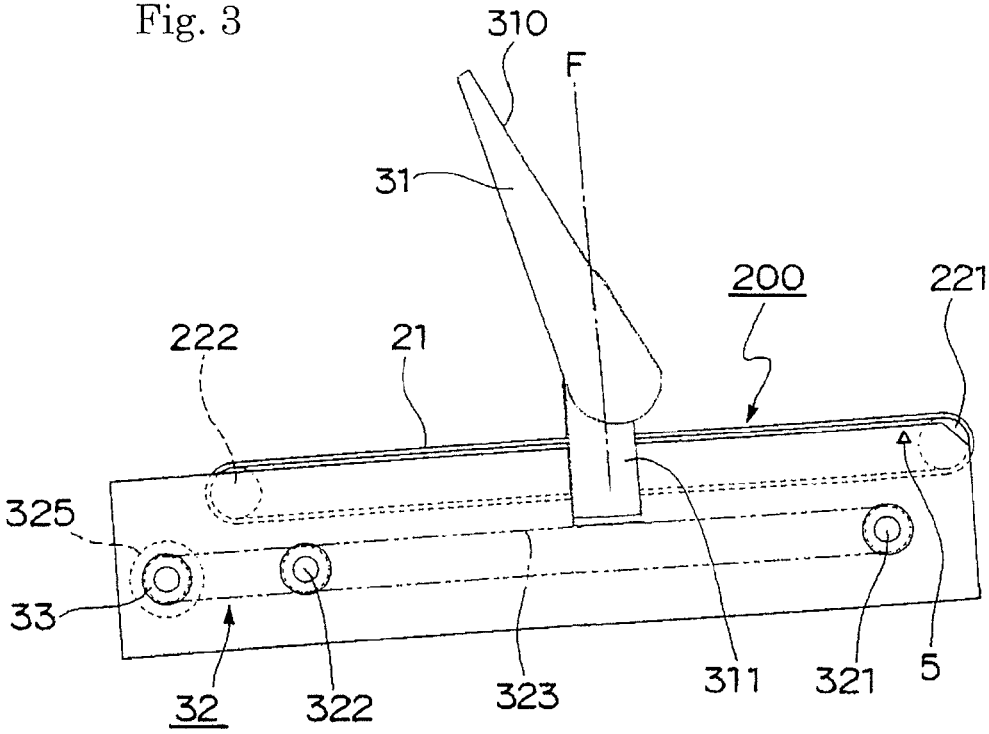
FIG. 3 is a view taken in the direction of an arrow III of FIG. 2.
Figure 4:
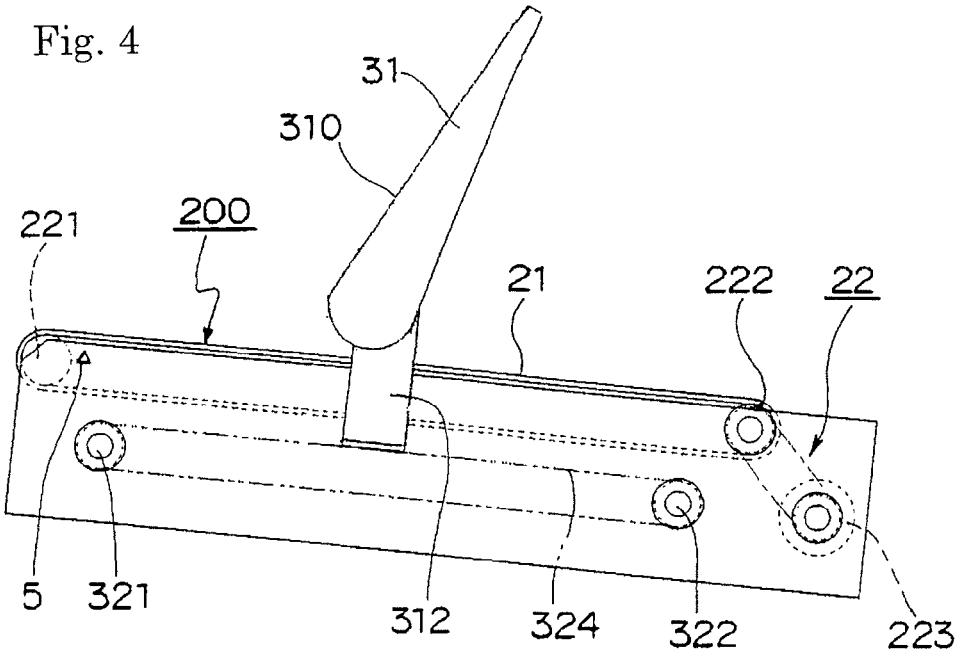
FIG. 4 is a view taken in the direction of an arrow IV of FIG. 2.
Figure 5:
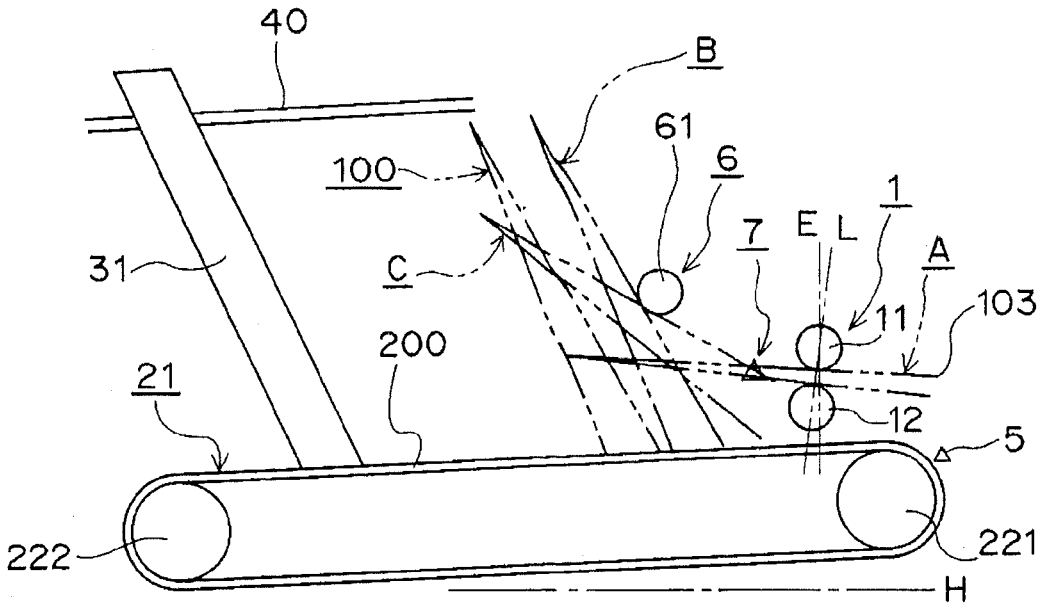
FIG. 5 is a schematic sectional view of the stacker device.

FIG. 1 is a perspective view of an embodiment of a stacker device of the present invention. This stacker device 10 is formed so as to stack paper sheets, which have been discharged from a discharging roller in a folded form, sequentially in a standing position from a downstream of a conveyance direction (direction X) to an upstream of the conveyance direction. FIG. 2 is a partially abbreviated plan view of the stacker device 10. FIG. 3 is a view taken in the direction of an arrow III of FIG. 2. FIG. 4 is a view taken in the direction of an arrow IV of FIG. 2. FIG. 5 is a schematic sectional view of the stacker device 10.

The stacker device 10 comprises: a discharging roller 1; a conveying belt 21 and a belt drive mechanism 22; a longitudinal receiving guide 31 and a guide drive mechanism 32; an upper edge regulatory guide 4; a paper sheet discharge detecting part 5; a first detecting part 6; a second detecting part 7; and a control part (not shown).

The discharging roller 1, as shown in FIG. 5, comprises an upper roller 11 and a lower roller 12 which nip the paper sheet 100 in a folded form and discharge it on a stacking surface 200 extending to the downstream of the conveyance direction. The discharging roller 1 is provided so that the line L which connects the rotation centers of both the rollers 11 and 12 is inclined with respect to the vertical line E toward the upstream side of the conveyance direction. This allows the discharging roller 1 to discharge the paper sheet 100 obliquely upward as indicated by an arrow.

The belt drive mechanism 22, especially as shown in FIG. 2, comprises two horizontal rollers 221 and 222 which are located in the upstream side and the downstream side of the conveyance direction respectively, and the drive motor 223 which rotatably drives the roller 222 of the downstream side. The conveying belt 21 is overlaid between the roller 221 and the roller 222, and its upper surface constructs the stacking surface 200. Incidentally, as is obvious from a horizontal surface H (FIG. 5), the conveying belt 21 is inclined to be lower for the downstream of the conveyance direction.

The guide drive mechanism 32, especially as shown in FIG. 2, comprises two rotation axes 321 and 322 which are located in the upstream side and the downstream side of the conveyance direction respectively; two drive belts 323 and 324 which are overlaid between both ends of the rotation axis 321 and the rotation axis 322; and a drive motor 325 which rotatably drives the rotation axis 322. The longitudinal receiving guide 31 is located on the stacking surface 200 and secured to the drive belts 323 and 324 by flanges 311 and 312 extending downward from both sides of a width direction (i.e., the direction indicated by an arrow Y in FIG. 2). And also, the longitudinal receiving guide 31 is formed so as to move with the movement of the drive belts 323 and 324.

The longitudinal receiving guide 31 is inclined a little toward the downstream side of the conveyance direction, with respect to a surface F (FIG. 3) which is perpendicular to the stacking surface 200. The longitudinal receiving guide 31, as shown in FIG. 1 and FIG. 2, comprises a receiving surface 310 constructed with wires 313 stretched over.

The upper edge regulatory guide 4 extends from a supporting arm 41 to the downstream of the conveyance direction. The supporting arm 41 extends from approximately just above the discharging roller 1 and inclines a little toward the downstream side of the conveyance direction. The upper edge regulatory guide 4 is supported by the supporting arm 41 so as to move up and down. The upper edge regulatory guide 4 has a pressing surface 40 constructed with wires 42 stretched over.

The paper sheet discharge detecting part 5 comprises a sensor which is located in more upstream side of the conveyance direction a little than the discharging roller 1. The paper sheet discharge detecting part 5 detects it when a rear edge 103 of the paper sheet 100 passing through the discharging roller 1 comes to the just above the detecting part 5, like a paper sheet A in FIG. 5.

Figure 6:
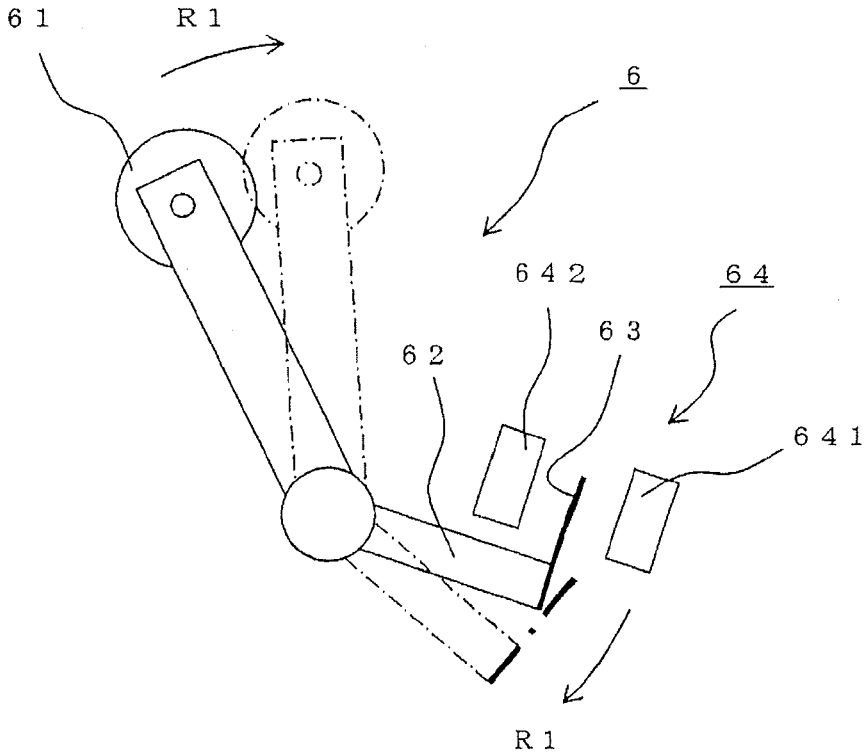
FIG. 6 is a side view of a main part of a first detecting part.

The first detecting part 6 is formed so as to detect it when the paper sheet 100 which is stacked on the stacking surface 200 and which is in the most upstream side of the conveyance direction makes contact with a horizontal rod body 61 from the downstream side of the conveyance direction, like a paper sheet B in FIG. 5. The first detecting part 6, as shown in FIG. 6, specifically, comprises the horizontal rod body 61 extending along a width direction; an arm 62 and a light-blocking plate 63 which cooperate with the rod body 61; and a sensor 64 which detects the movement of the light-blocking plate 63. The sensor 64 comprises a pair of sensor parts 641 and 642 provided to be opposed each other. In a construction in FIG. 6, when the paper sheet 100 makes contact with the rod body 61 from the downstream side of the conveyance direction, the rod body 61 turns a little to the direction indicated by an arrow R1, and the arm 62 and the light-blocking plate 63 cooperate with the rod body 61 and also turn a little to the direction indicated by the arrow R1, and as a result, the light-blocking plate 63 gets out from between a pair of the sensor parts 641 and 642. Therefore, the sensor 64 turns on, and as a result, the contact of the paper sheet 100 with the rod body 61 is detected. When the paper sheet 100 moves away from the rod body 61; the rod body 61, the arm 62, and the light-blocking plate 63 turn to the opposite direction to the above-mentioned direction, and the light-blocking plate 63 gets into between the sensor parts 641 and 642 to interrupt between a pair of the sensor parts 641 and 642. Therefore, the sensor 64 turns off, and as a result, the paper sheet 100 is not detected by the first detecting part 6.

The second detecting part 7 is formed so as to detect it when the paper sheet 100 which is stacked on the stacking surface 200 and which is in the upstream side of the conveyance direction become a non-standing position, i.e., a collapsed state, like a paper sheet C in FIG. 5. The second detecting part 7, specifically, comprises a pair of sensor parts 71 and 72 (FIG. 2) which are located in both sides of the width direction. When the paper sheet 100 in the collapsed state interrupts between a pair of the sensor parts 71 and 72, the second detecting part 7 detects that the paper sheet 100 is collapsed.

The control part is formed so as to control both of the guide drive mechanism 32 and the belt drive mechanism so that after the predetermined time T, which is required for the paper sheet to be stacked on the stacking surface 200 after the paper sheet discharge detecting part 5 detects the rear edge 103 of the paper sheet 100 having been conveyed to the discharging roller 1, passes and until the first detecting part 6 detects the paper sheet 100, the longitudinal receiving guide 31 and the conveying belt 21 move to the upstream side of the conveyance direction at the same time, and after that, until the first detecting part 6 does not detect the paper sheet 100, the longitudinal receiving guide 31 and the conveying belt 21 move to the downstream side of the conveyance direction at the same time. Additionally, the control part is formed so as to control the belt drive mechanism 22 so that, when the second detecting part 7 detects the collapsed state of the paper sheet 100, only the conveying belt 21 moves to the downstream side of the conveyance direction by the predetermined distance.

Next, it is explained about an operation of the stacker device 1 having the above-mentioned construction.

Figure 7:
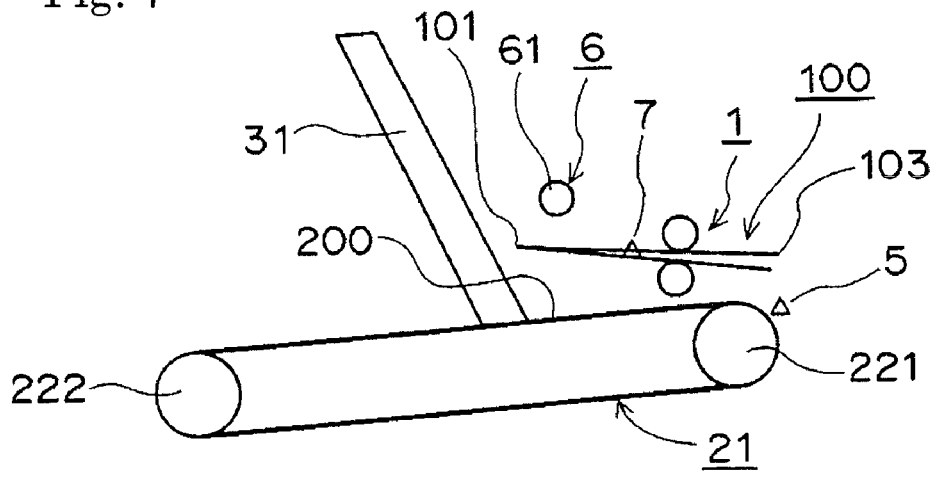
FIG. 7 is a schematic sectional view showing a start status of operation of the stacker device.
Figure 8:
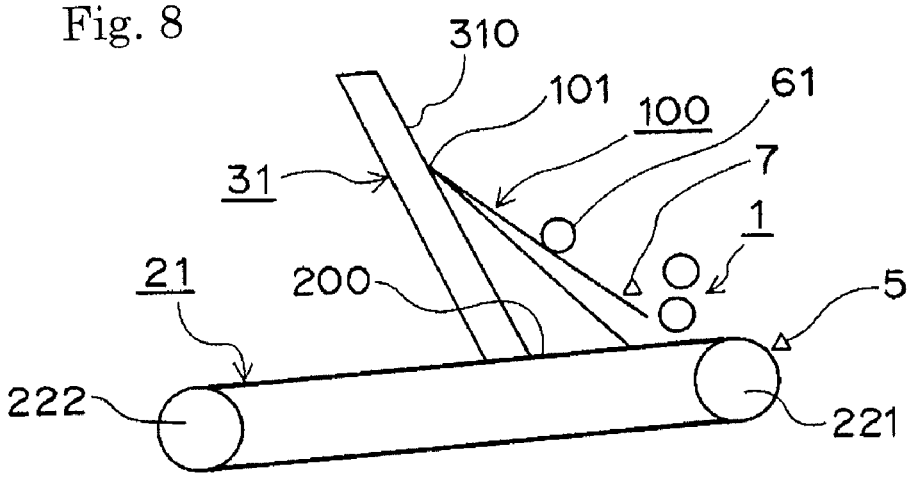
FIG. 8 is a schematic sectional view showing the operation subsequent to FIG. 7.
Figure 9:
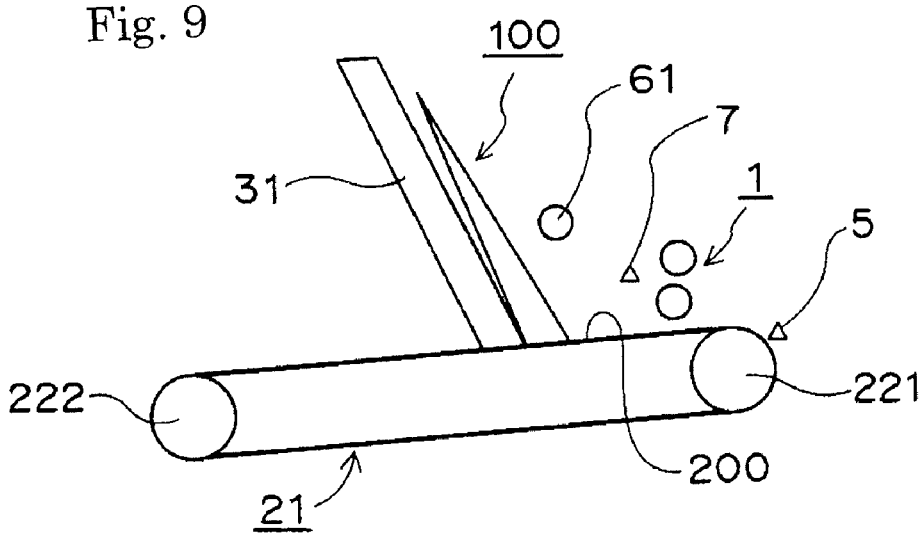
FIG. 9 is a schematic sectional view showing the operation subsequent to FIG. 8.

Firstly, as shown in FIG. 7, a first V-folded paper sheet 100 is discharged from the discharging roller 1 with the fold line 101 located in front. At this time, the rear edge 103 of the paper sheet 100 is detected by the paper sheet discharge detecting part 5. After this detection and by taking the predetermined time T, the paper sheet 100, as shown in FIG. 8, is moved upward along the receiving surface 310 of the longitudinal receiving guide 31 with the fold line 101 located in front, and then, as shown in FIG. 9, the paper sheet 100 becomes a standing position along the receiving surface 310. According to this, the paper sheet 100 is received by the longitudinal receiving guide 31. Namely, the paper sheet 100 is stacked on the stacking surface 200. Incidentally, at the operating time when the paper sheet 100 is being discharged from the discharging roller 1, the first detecting part 6 and the second detecting part 7 stop its operations.

Figure 10:
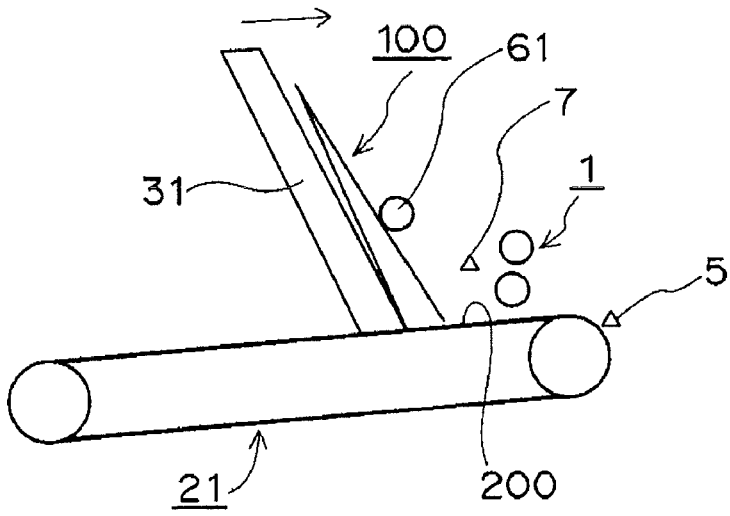
FIG. 10 is a schematic sectional view showing the operation subsequent to FIG. 9.

Next, after the predetermined time T, the guide drive mechanism 32 and the belt drive mechanism 22 are controlled by the control part, so that the longitudinal receiving guide 31 and the conveying belt 21 move to the upstream side of the conveyance direction at the same time until the paper sheet 100 makes contact with the rod body 61 from the downstream side of the conveyance direction, i.e., until the first detecting part 6 detects the contact of the paper sheet 100 with the rod body 61, i.e., until the paper sheet 100 becomes a state of FIG. 10.

Figure 11:
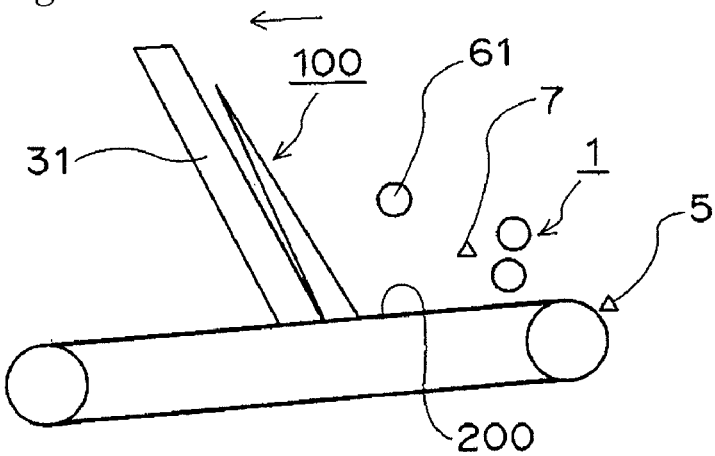
FIG. 11 is a schematic sectional view showing the operation subsequent to FIG. 10.

Next, when the first detecting part 6 detects the contact of the paper sheet 100 with the rod body 61, the guide drive mechanism 32 and the belt drive mechanism 22 are controlled by the control part, so that the longitudinal receiving guide 31 and the conveying belt 21 move to the downstream side of the conveyance direction at the same time until the paper sheet 100 is no longer detected by the first detecting part 6, i.e., until the paper sheet 100 becomes a state of FIG. 11.

Figure 12:
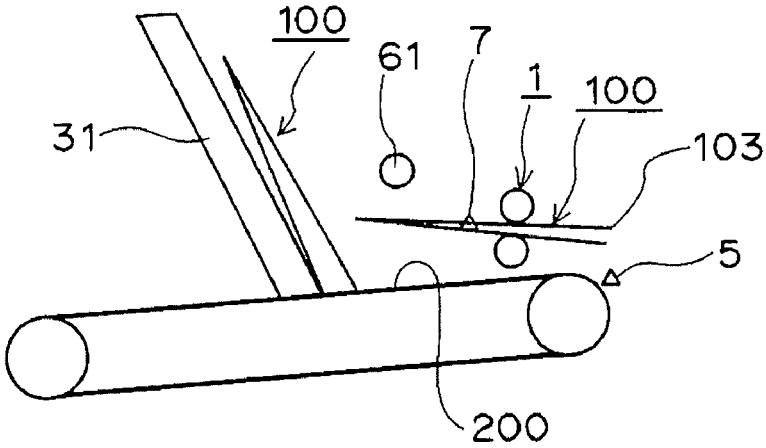
FIG. 12 is a schematic sectional view showing the operation subsequent to FIG. 11.
Figure 13:
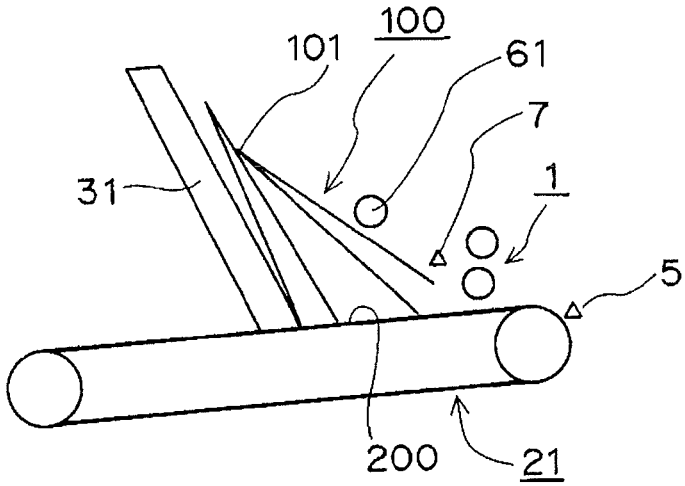
FIG. 13 is a schematic sectional view showing the operation subsequent to FIG. 12.
Figure 14:
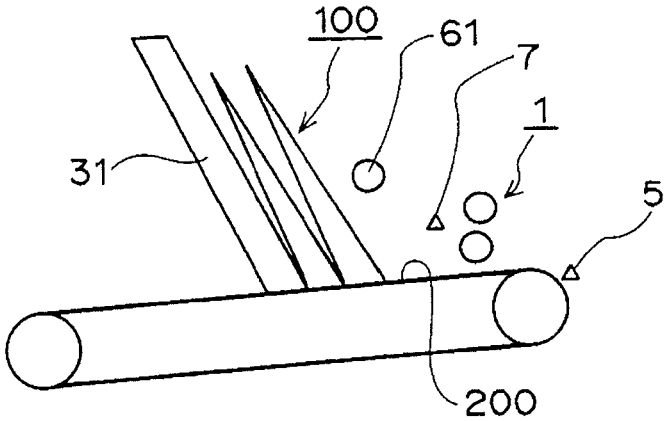
FIG. 14 is a schematic sectional view showing the operation subsequent to FIG. 13.

Next, as shown in FIG. 12, the second paper sheet 100 is discharged from the discharging roller 1 with the fold line 101 located in front. At this time, the rear edge 103 of the second paper sheet 100 is detected by the paper sheet discharge detecting part 5. After this detection and by taking the predetermined time T, the second paper sheet 100, as shown in FIG. 13, is moved upward along the first paper sheet 100 with the fold line 101 located in front, and then, as shown in FIG. 14, becomes a standing position along with the first paper sheet 100. According to this, the second paper sheet 100 is stacked on the stacking surface 200.

Figure 15:
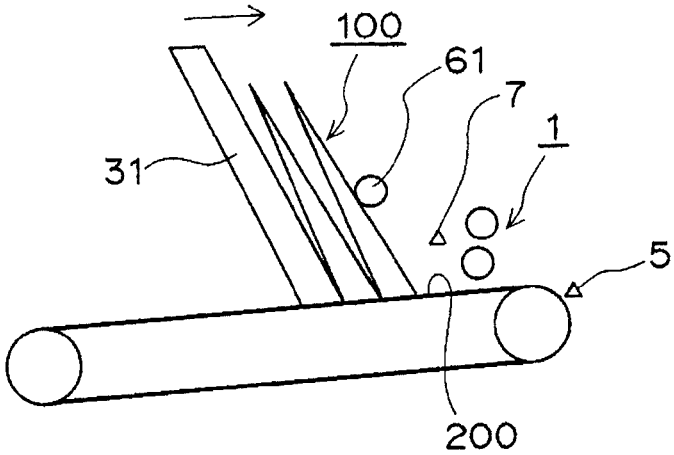
FIG. 15 is a schematic sectional view showing the operation subsequent to FIG. 14.

Next, after the predetermined time T, the guide drive mechanism 32 and the belt drive mechanism 22 are controlled by the control part, so that the longitudinal receiving guide 31 and the conveying belt 21 move to the upstream side of the conveyance direction at the same time until the second paper sheet 100 makes contact with the rod body 61 from the downstream side of the conveyance direction, i.e., until the first detecting part 6 detects the contact of the second paper sheet 100 with the rod body 61, i.e., until the paper sheets 100 become a state of FIG. 15.

Figure 16:
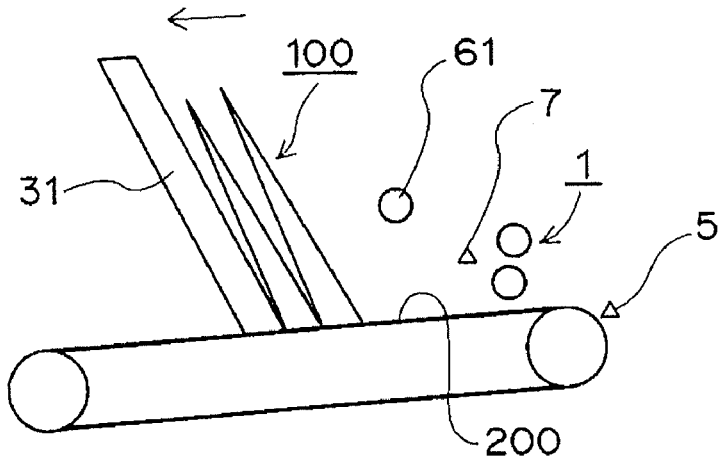
FIG. 16 is a schematic sectional view showing the operation subsequent to FIG. 15.

Next, when the first detecting part 6 detects the contact of the second paper sheet 100 with the rod body 61, the guide drive mechanism 32 and the belt drive mechanism 22 are controlled by the control part, so that the longitudinal receiving guide 31 and the conveying belt 21 move to the downstream side of the conveyance direction at the same time until the second paper sheet 100 is no longer detected by the first detecting part 6, i.e., until the paper sheets 100 become a state of FIG. 16.

Further continuously, the third paper sheet 100 is stacked on the stacking surface 200 and moved, as in the case of the second paper sheet 100 in FIG. 12-FIG. 16.

In this way, in the stacker device 1 having the above-mentioned construction, each time one of the paper sheets 100 is stacked on the stacking surface 200, all the stacked paper sheets 100 are moved to the upstream side of the conveyance direction and then moved to the downstream side of the conveyance direction, i.e., all the stacked paper sheets 100 are swung between the longitudinal receiving guide 31 and the rod body 61.

Additionally, in the middle of the above-mentioned operation, if the paper sheet 100 stacked on the stacking surface 200 becomes a non-standing position, i.e., the collapsed state, the stacker device 1 having the above-mentioned construction operates as mentioned below.

Figure 17:
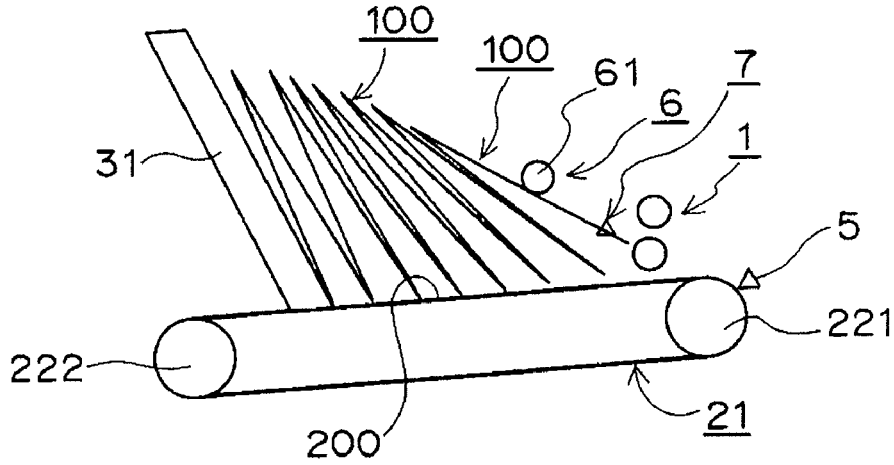
FIG. 17 is a schematic sectional view showing a state in which the stacked paper sheets are collapsed.
Figure 18:
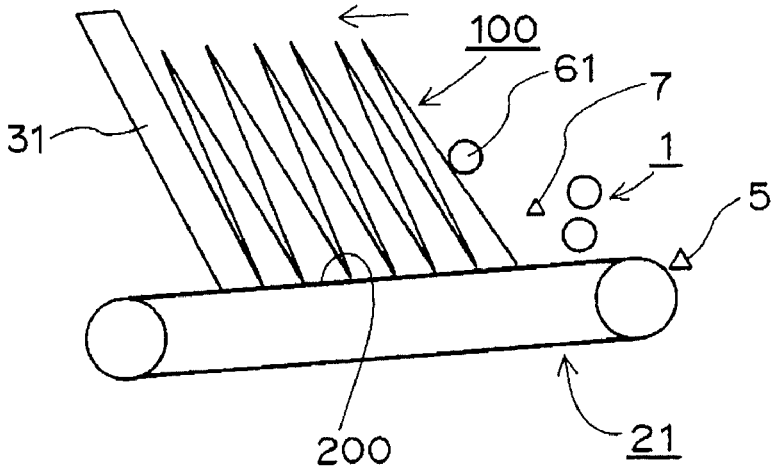
FIG. 18 is a schematic sectional view showing the operation subsequent to FIG. 17.

For example, as shown in FIG. 17, when a number of the paper sheets 100 in the folded form are collapsed, the collapsed state of the paper sheets 100 in the upstream side of the conveyance direction is detected by the second detecting part 7. According to this, only the belt drive mechanism 22 is controlled by the control part, so that only the conveying belt 21 moves to the downstream side of the conveyance direction by the predetermined distance. At this time, the paper sheets 100 are pressed by the conveying belt 21 to the longitudinal receiving guide 31 having been stopped. Therefore, the paper sheets 100 in the collapsed state come to stand gradually while being conveyed, and as a result, as shown in FIG. 18, become a standing position.

The stacker device 1 having the above-mentioned construction can exert the following effects.

(1) Each time one of the paper sheets 100 is stacked on the stacking surface 200, the conveying belt 21 moves to the upstream side of the conveyance direction and then moves to the downstream side of the conveyance direction, together with the longitudinal receiving guide 31, i.e., together with the stacked paper sheets 100. Therefore, the following effects can be exerted.

(1-1) The conveying belt 21 hardly slidingly makes contact with the lower edges 102 of the stacked paper sheets 100. Therefore, the lower edges 102 of the paper sheets 100 can be prevented from being damaged.

(1-2) Each time one of the paper sheets 100 is stacked on the stacking surface 200, all the stacked paper sheets 100 are swung between the longitudinal receiving guide 31 and the rod body 61. Therefore, each time the paper sheet 100 is stacked, the stacked state of the paper sheets 100 is fixed. Accordingly, the stacked state of the paper sheets 100 can be stabilized, namely, the stacked paper sheets 100 can be controlled from being collapsed.

(2) If the stacked paper sheets 100 are collapsed, only the conveying belt 21 moves to the downstream side of the conveyance direction by the predetermined distance. Therefore, the paper sheets 100 can stand. Therefore, it is possible to eliminate the need for manual works to rebuild the collapsed paper sheets 100. Accordingly, the work efficiency of the device can be improved.

(3) There is a possibility that the paper sheet 100 being discharged from the discharging roller 1 stirs upward of the longitudinal receiving guide 31 because of its impulse. Especially, there is a possibility that the paper sheet 100 stacked just before is stirred upwardly by the paper sheet 100 coming behind. However, since the upper edge of the paper sheet 100 to be received by the longitudinal receiving guide 31 is regulated by the upper edge regulatory guide 4, the paper sheet 100 can be surely prevented from being stirred upwardly.

(4) Since the conveying belt 21 is inclined to be lower for the downstream side of the conveyance direction, the paper sheets 100 can smoothly stand to the longitudinal receiving guide 31.

(5) Since the discharging roller 1 can discharge the paper sheet 100 obliquely upward, the paper sheet 100 can smoothly stand to the longitudinal receiving guide 31.

INDUSTRIAL APPLICABILITY

The stacker device of the present invention can prevent the occurrence of troubles, such as the lower edges of the paper sheets are damaged or the stacked paper sheets are collapsed, and therefore, it has a high industrial applicability.

The invention claimed is:

1. A stacker device for stacking paper sheets, which have been discharged from a discharging roller in a folded form, sequentially in a standing position from a downstream side of a conveyance direction to an upstream side of the conveyance direction, the device comprising:

a conveying belt which constructs a stacking surface of the paper sheet and which is provided movable in the conveyance direction by a belt drive mechanism;

a longitudinal receiving guide which is provided movable on the stacking surface in the conveyance direction by a guide drive mechanism and which receives the paper sheets having been discharged, in the standing position in the upstream side of the conveyance direction;

a paper sheet discharge detecting part for detecting a rear edge of the paper sheet having been conveyed to the discharging roller;

a first detecting part for detecting that the paper sheet which is stacked on the stacking surface and which is in the most upstream side of the conveyance direction makes contact with a horizontal rod body which is orthogonal to the conveyance direction and which is located above the stacking surface, from the downstream side of the conveyance direction; and a control part for controlling the guide drive mechanism and the belt drive mechanism;

wherein the control part is formed so as to control both of the guide drive mechanism and the belt drive mechanism so that after the predetermined time, which is required for the paper sheet to be stacked on the stacking surface after the paper sheet discharge detecting part detects the rear edge of the paper sheet having been conveyed to the discharging roller, passes and until the first detecting part detects the paper sheet, the longitudinal receiving guide and the conveying belt move to the upstream side of the conveyance direction at the same time, and after that, until the first detecting part does not detect the paper sheet, the longitudinal receiving guide and the conveying belt move to the downstream side of the conveyance direction at the same time.

2. The stacker device according to claim 1, further comprises a second detecting part for detecting a non-standing position of the paper sheet in the upstream side of the conveyance direction on the stacking surface, wherein the control part is formed so as to control the belt drive mechanism so that, when the second detecting part detects the non-standing position of the paper sheet, only the conveying belt moves to the downstream side of the conveyance direction by the predetermined distance.

* * * * *